US007735441B2

(12) United States Patent
Borum et al.

(10) Patent No.: US 7,735,441 B2
(45) Date of Patent: Jun. 15, 2010

(54) LIFT APPARATUS FOR A WATERCRAFT

(75) Inventors: Paul W. Borum, Holland, MI (US); Roger Doane, Belmont, MI (US)

(73) Assignee: A&B Machining, Inc., Fruitport, MI (US)

( * ) Notice: Subject to any disclaimer, the term of this patent is extended or adjusted under 35 U.S.C. 154(b) by 0 days.

(21) Appl. No.: 12/313,241

(22) Filed: Nov. 18, 2008

(65) Prior Publication Data

US 2010/0122651 A1 May 20, 2010

(51) Int. Cl.
*B63B 35/40* (2006.01)

(52) U.S. Cl. ..... 114/259; 114/369; 114/371

(58) Field of Classification Search ..... 114/259, 114/369–373

See application file for complete search history.

(56) References Cited

U.S. PATENT DOCUMENTS

| | | | | |
|---|---|---|---|---|
| 720,274 | A * | 2/1903 | Murchison | 114/371 |
| 1,893,157 | A * | 1/1933 | Burrill et al. | 114/370 |
| 2,173,421 | A * | 9/1939 | Krzeminsky | 114/370 |
| 7,478,608 | B2 * | 1/2009 | Wesley | 114/373 |

* cited by examiner

*Primary Examiner*—Ed Swinehart
(74) *Attorney, Agent, or Firm*—The Watson I.P. Group, PLC; Jovan N. Jovanovic; Vladan M. Vasiljevic

(57) ABSTRACT

A lift apparatus for a watercraft having a plurality of components positioned below the platform at the aft end of a boat. The lift apparatus is configured to lift and deploy a watercraft from an undeployed orientation overlaying a platform to a deployed orientation away from the platform and on the water. In the deployed orientation the platform is substantially free from any lift apparatus component interference.

15 Claims, 6 Drawing Sheets

LIFT APPARATUS FOR A WATERCRAFT

BACKGROUND OF THE DISCLOSURE

1. Field of the Disclosure

The disclosure relates in general to watercraft lifting assemblies, and more particularly, to a lift apparatus for a watercraft. Although not limited thereto, the lift apparatus is particularly useful for the deployment of watercraft that are typically positioned on a platform (such as a swim platform) of a boat.

2. Background Art

The storage and deployment of small watercraft from larger boats has long been problematic. For many leisure boats, a watercraft, such as a dingy, is often carried behind the boat, and, often on the swim platform.

With some dingys being quite large, there have been developed a number of mechanisms that can assist with the placement of the dingy on a fabricated extension of the swim platform. Certain of these solutions are quite difficult to implement and require extensive modification to the boat. For casual leisure boat users, such modifications are quite expensive, as are the devices themselves.

Other devices for stowage of watercraft on swim platforms require the use of pulleys and manually positioned and operated lifts and stands. Such stands, lifts and pulleys are typically mounted on the boat or on the swim platform itself. Thus, while assisting with the stowage of the watercraft, the components are invariably in the way of the boaters. Often, these components cause injury to users of the swim platform. In some instances, the components are removable, however, in such cases, many get lost or inadvertently fall overboard and sink.

It is an object of the present invention to provide a watercraft lift apparatus that overcomes the deficiencies set forth above.

It is another object of the present invention to provide a watercraft lift apparatus that provides easy deployment of a watercraft with minimal invasiveness to the swim platform of the boat.

These objects as well as other objects of the present invention will become apparent in light of the present specification, claims, and drawings.

SUMMARY OF THE DISCLOSURE

The disclosure is directed to a lift apparatus for loading and unloading of a watercraft from the transom of a boat whereby the lift apparatus moves around and over a platform. The platform may comprise a swim platform positioned at the aft end of a pleasure boat. The lift apparatus comprises a first arm, a second arm, a power arm, a displacing member, a folding arm and a cradle assembly. The first arm has a first end pivotably connected to an outside surface below a platform. The second arm has a first end pivotably connected to an outside surface below a platform. The power arm has a first end pivotably coupled to a second end of the second arm and a second end pivotably coupled to a second end of the first arm. The displacing member includes a first end, a second end and a variable length. The first end is coupled to the outside surface and the second end coupled to the first arm proximate the second end thereof. The folding arm has a first end and a second end. The first end of the folding arm is pivotably coupled to the second end of the first arm and rotationally fixed to the second end of the power arm. The cradle assembly has a cradle arm with a first end and a second end and a cradle pad. The cradle pad is positioned at the second end of the cradle arm and is configured to receive a watercraft thereon. The first end of the cradle assembly is pivotably coupled to the second end of the folding arm and rotationally fixed to the second end of the power arm. As set forth below, upon variation of the length of the displacing member, the displacing member rotates the first and second arms about the first end and rotates the power arm about the first and second ends thereof. In turn the folding arm and the cradle assembly rotates from an undeployed orientation wherein the folding arm, and the cradle arm are substantially above the platform along with a watercraft positioned upon the cradle pad to a deployed orientation wherein the folding arm, and the cradle arm are extended away from and below the platform to clear and lower the watercraft over and around the platform.

In a preferred embodiment, the lift apparatus further includes a folding arm control system rotationally fixing the second end of the folding arm to the second end of the power arm. The folding arm control system comprises a ring gear fixedly coupled to one of the power arm and the folding arm, a ring gear fixedly coupled to the other of the power arm and the folding arm, and, a planetary gear engages each of the sun gear and ring gear, to transfer motion therebetween.

In one such preferred embodiment, or in another preferred embodiment, the lift apparatus further includes a cradle arm control assembly. The cradle arm control assembly comprises a master sprocket fixedly coupled to the power arm and a follower sprocket fixedly coupled to the first end of the cradle arm. A chain extends about each of the follower sprocket and the master sprocket to rotatably couple the same.

In another preferred embodiment, the lift apparatus further includes a mounting bracket configured to engage an outside surface and configured to provide a mounting for the first ends of each of the first arm, the second arm and the displacing member.

In another preferred embodiment, the displacing member further comprises a hydraulic cylinder.

In a preferred embodiment, the cradle pad is configured so that the watercraft positioned thereon remains substantially horizontally positioned between the deployed and undeployed orientations.

In another aspect of the invention, the invention comprises a boat and watercraft lift apparatus in combination having the structural features set forth above.

In yet another aspect of the invention, the invention comprises a method for selectively deploying a watercraft from a platform. The method comprises the steps of providing the lift apparatus identified above in the embodiments; actuating the lift apparatus to lengthen the length of the displacing member; rotating the first and second arms, to in turn, raise the watercraft from the platform; displacing the watercraft outwardly and away from the platform; and downwardly moving the watercraft once the watercraft has moved outwardly beyond the platform toward the waterline.

BRIEF DESCRIPTION OF THE DRAWINGS

The disclosure will now be described with reference to the drawings wherein:

FIG. 3 of the drawings comprises a schematic representation of the lift apparatus between the deployed and the undeployed orientation;

FIG. 4 of the drawings comprises a schematic representation of the lift apparatus between the deployed and the undeployed orientation;

FIG. 5 of the drawings comprises a schematic representation of the lift apparatus between the deployed and the undeployed orientation;

FIG. 6 of the drawings comprises a schematic representation of the lift apparatus between the deployed and the undeployed orientation;

FIG. 7 of the drawings comprises a schematic representation of the lift apparatus at or near the deployed orientation;

DETAILED DESCRIPTION OF THE DISCLOSURE

Figure 1:
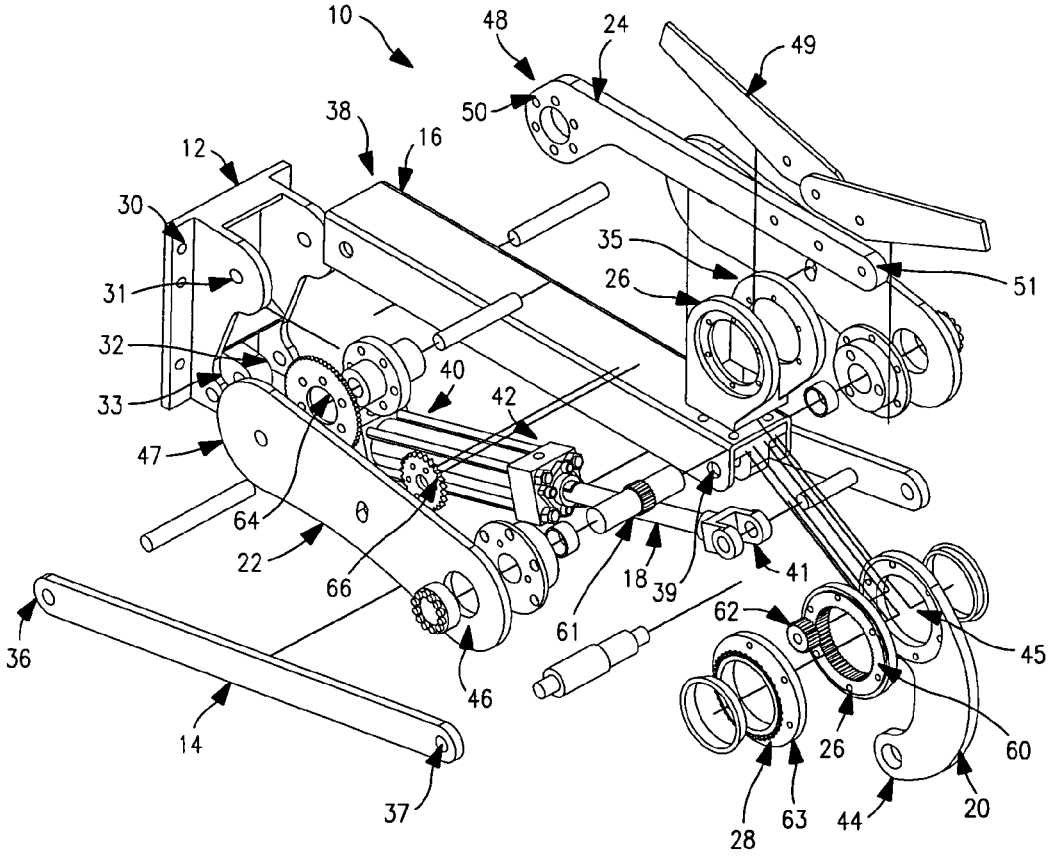
FIG. 1 of the drawings is an exploded view of the lift apparatus of the present invention.
Figure 2:
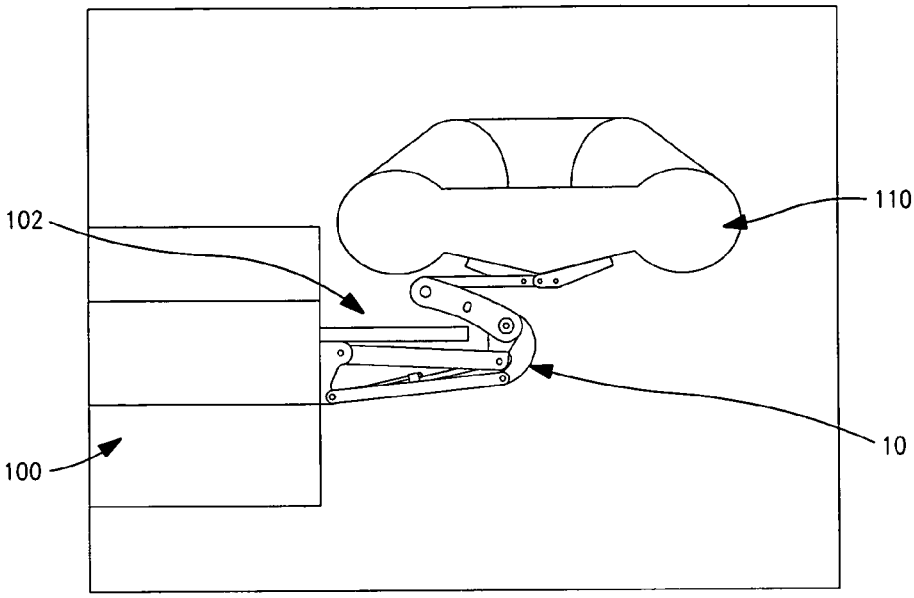
FIGS. 2 through 7 comprise schematic representations of the movement of the lift apparatus from the undeployed to the deployed orientation, wherein, FIG. 2 of the drawings comprises a schematic representation of the lift apparatus in the undeployed orientation.
Figure 3:
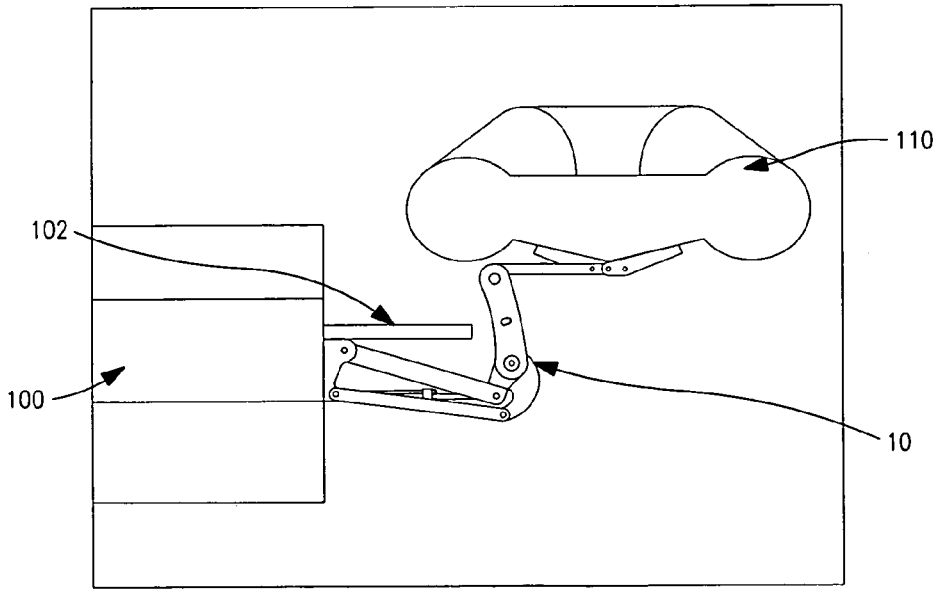
Figure 4:
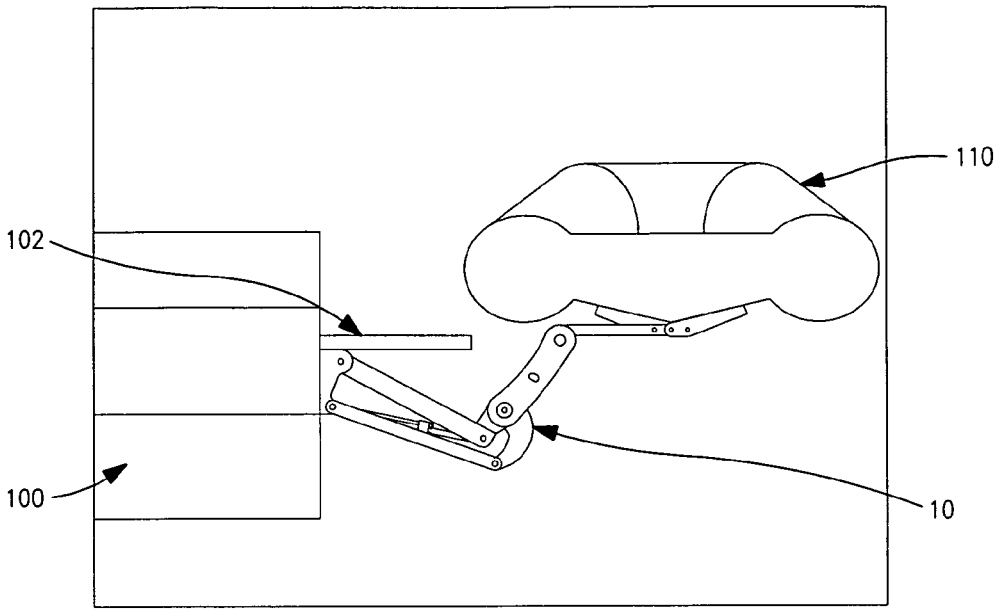
Figure 5:
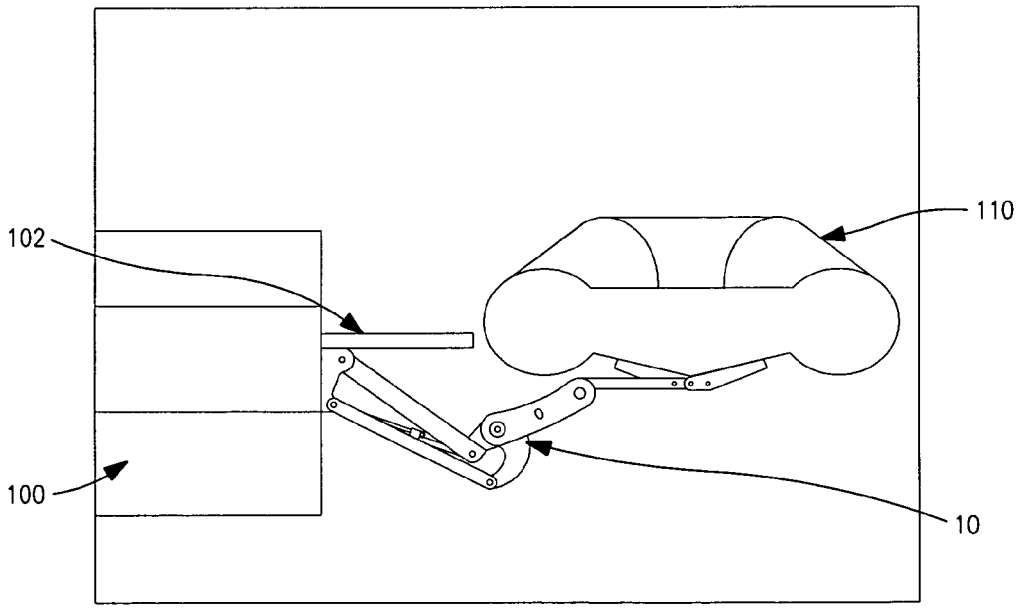
Figure 6:
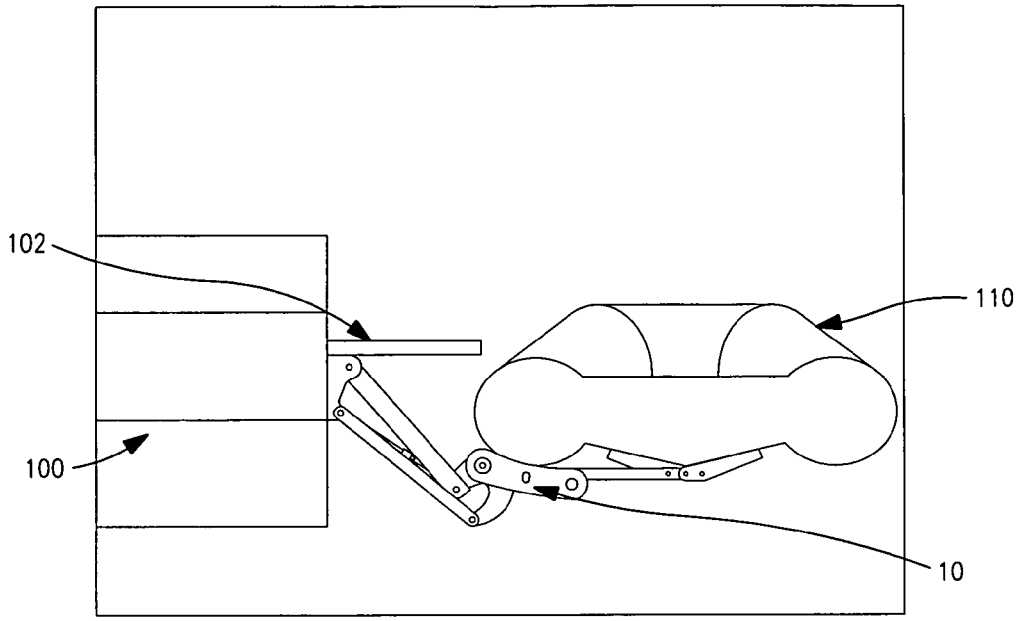
Figure 7:
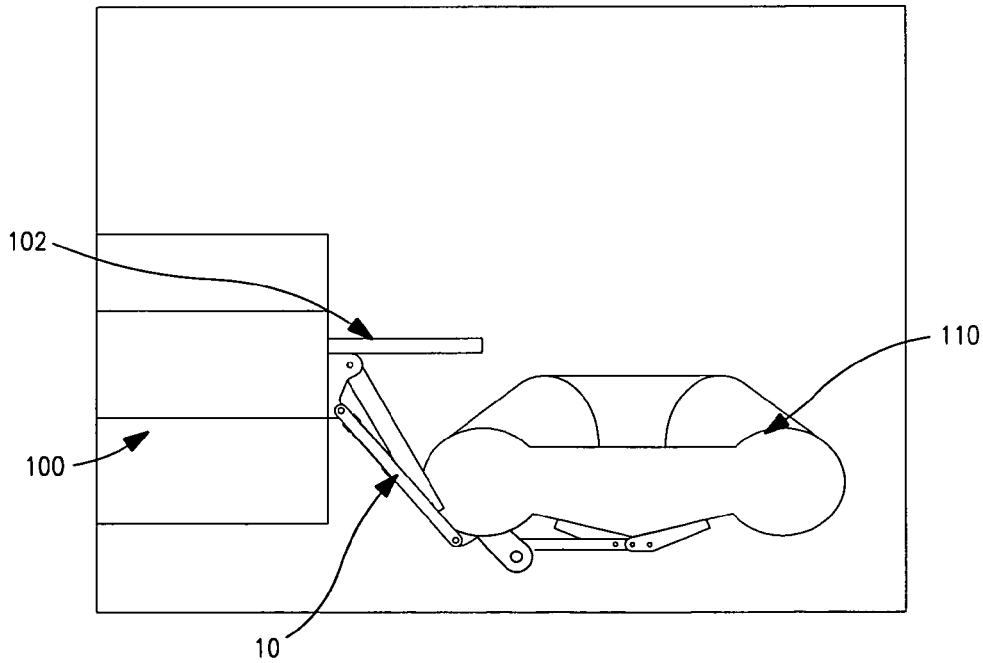

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, lift apparatus is shown generally at 10. The lift apparatus 10 is configured to selectively deploy and undeploy (or stow) a watercraft 110 from a platform 102 of a boat 100. Initially, in an undeployed orientation, the watercraft is positioned so as to overlay the platform 101. During deployment, the lift apparatus lifts up the watercraft, moves the watercraft outwardly away from the boat so that it no longer overlies the platform. Finally, the lift apparatus moves the watercraft downwardly toward the waterline. Depending on configuration, the craft can be set onto the water. It will be understood that much of the lift apparatus is positioned below the waterline and out of the way of the platform. Thus, when there is no watercraft on the platform, full enjoyment of the platform can be realized without running into components of the lift apparatus.

With particular reference to FIG. 1, the lift apparatus 10 includes mounting bracket 12, first arm 14, second arm, 16, displacing member 18, power arm 20, folding arm 22, cradle assembly 24, folding arm control assembly 26 and cradle arm control assembly 28. The mounting bracket 12 is configured to be attached to aft of the boat below the platform. The mounting bracket may be attached to the boat using screws, bolts or other fasteners, with care being taken to properly seal the openings created by the fasteners.

Figure 8:
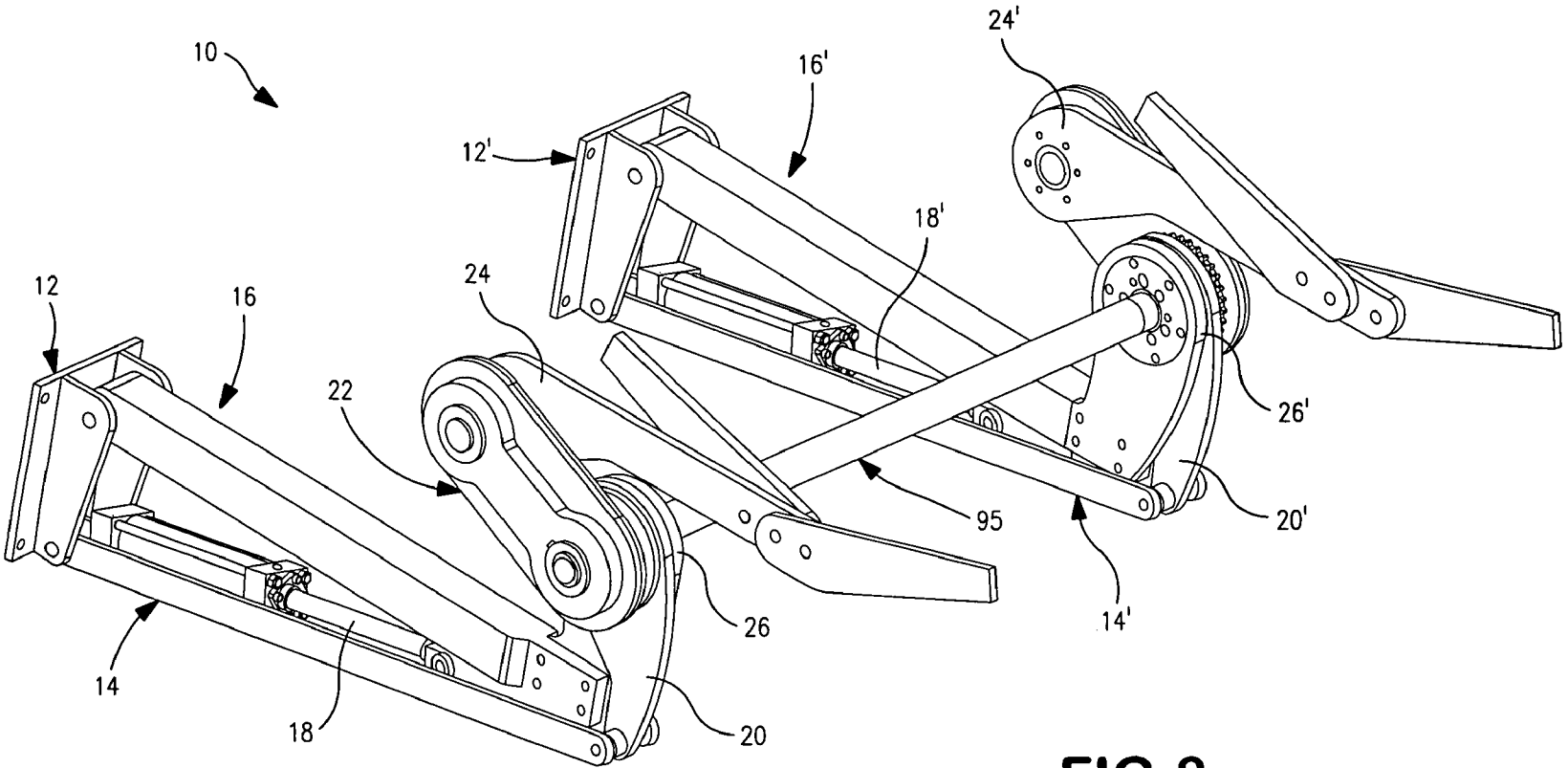
FIG. 8 of the drawings comprises a perspective view of another embodiment of the lift apparatus of the present invention.

With reference to FIG. 8, it will be understood that the lift apparatus may further include a pair of the foregoing assemblies that work in unison and that are joined together by locating rod 95. The similar components have been identified with like reference numbers augmented by a prime (′). It will be understood that the description below will describe one of the assemblies with the understanding that the other (or others where there are more than two assemblies) are substantially identical and move in substantially the same manner.

Typically, the mounting bracket includes a plurality of openings which define pivots for a number of the other components (namely, the first arm, the second arm and the displacing member). In particular, the mounting bracket includes first arm bracket 31, second arm bracket 32 and displacing member bracket 33. In the embodiment shown, the three brackets provide three pairs of openings which provide three parallel axis of rotation one for each of the first arm 14, the second arm 16 and the displacing member 18.

Figure 9:
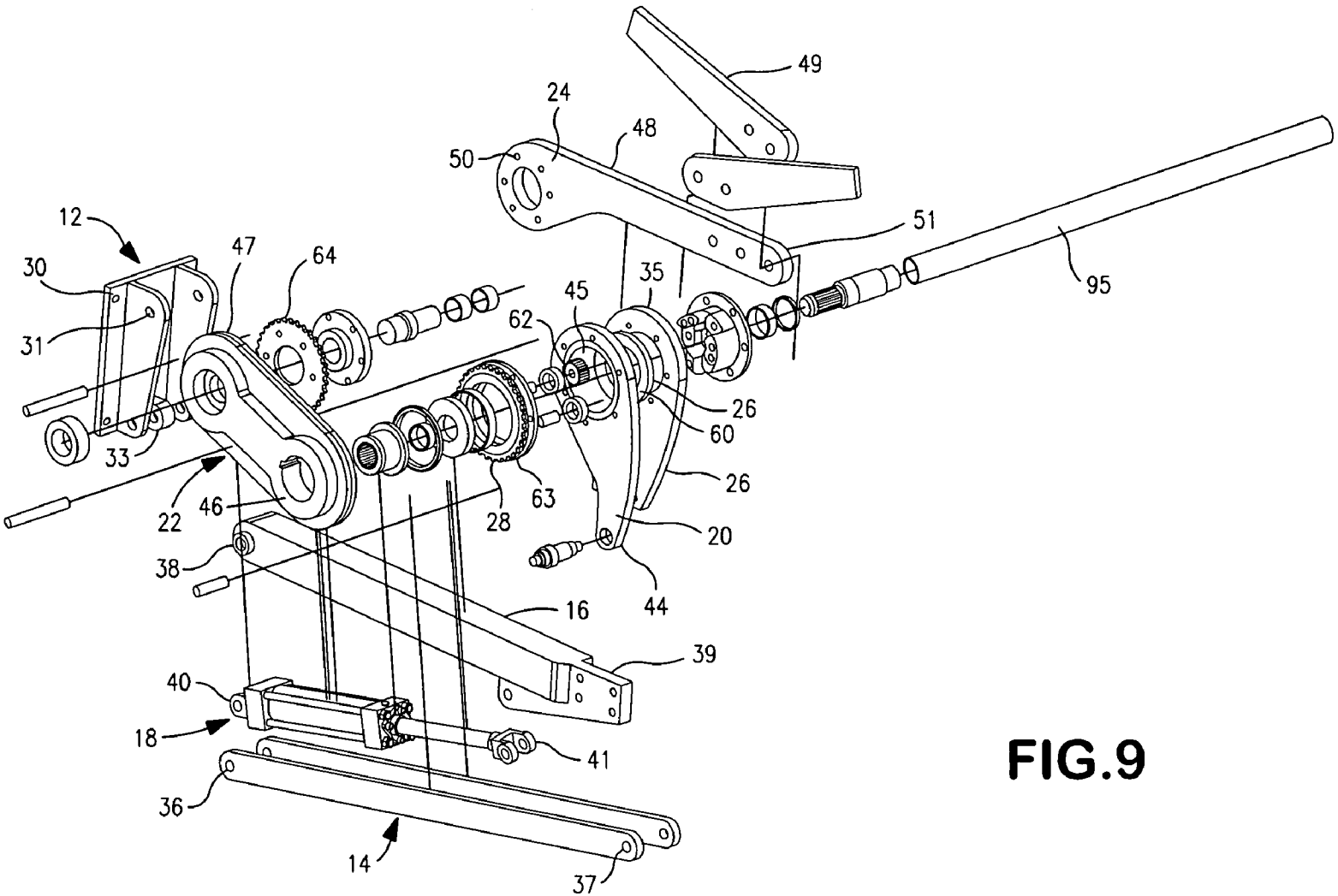
FIG. 9 of the drawings comprises an exploded view of the embodiment of the lift apparatus of the present invention shown in FIG. 8.

The first arm 14 is shown in FIGS. 1 and 9 as comprising proximal end 36 and distal end 37. The first end 36 is pivotably coupled to the first arm bracket 31 of the mounting bracket 12. The second end 37 is pivotably coupled to the first end 44 of the power arm 20. The first arm preferably operates generally below the platform and resides below the platform in each of the deployed and undeployed orientations.

The second arm 16 is shown in FIGS. 1 and 9 as comprising first end 38 and second end 39. The second end includes pivot mounting bracket 35 to which the second end 45 of the power arm 20 is coupled. The first end 38 of the second arm is pivotably coupled to the second arm bracket 32 of the mounting bracket 12. Additionally, the second end 41 of the displacing member 18 is coupled to the second end 39 of the second arm. As will be explained below, the pivot mounting bracket 35 provides a housing for the folding arm control assembly 26.

The displacing member 18 is shown in FIGS. 1 and 9 as comprising first end 40, second end 41 and means 42 for varying the length thereof. In the embodiment shown, the displacing member comprises a hydraulic cylinder. In other embodiments, the length varying means may comprise an elongated screw (such as a scissor jack or the like that is rotationally coupled to an electric motor or the like). The first end 40 of the displacing member is coupled to the displacing member bracket 33. The second end 42 of the displacing member is coupled to the second end of the second arm 16. It will be understood that as the length of the displacing member increases, the first and second arms rotate so that the second ends thereof move in a generally upward direction. As the length of the displacing member decreases, the first and second arms rotate so that the second ends thereof move in a generally downward direction.

Power arm 20 is shown in FIGS. 1 and 9 as comprising first end 44 and second end 45. The first end 44 is pivotably connected to the second end 37 of the first arm 14. The second end 37 is pivotably connected to the pivot mounting bracket 35 at the distal end 39 of the second arm 16. As the first and second arms are rotated by the displacing member, the power arm will both translate and rotate.

The folding arm 22 is shown in FIGS. 1 and 9 as comprising first end 46 and second end 47. The first end is pivotably coupled to the second end of the second arm 16 and rotationally fixed to the second end 45 of the power arm. Thus, as the power arm rotates, the folding arm rotates in some proportion thereto. The control of this movement is achieved through the folding arm control assembly which will be described below. The second end 47 of the folding arm 22 is coupled to the first end 50 of the cradle arm 48.

The cradle assembly 24 is shown in FIGS. 1 and 9 as comprising cradle arm 48 and cradle pad 49. The cradle arm includes first end 50 and second end 51. The first end 50 of the cradle arm 48 is rotationally coupled to the second end of the folding arm 22. Additionally, through the cradle arm control assembly (which will be described below), the first end of the cradle arm is rotationally fixed to the second end of the power arm.

The cradle arm 48 comprises a generally V-shaped (or pair of V-shaped) members which are configured to receive a watercraft thereon and to retain a watercraft in a desired orientation on the cradle arm.

The folding arm control assembly 26 is shown in FIGS. 1 and 9 as comprising ring gear 60, sun gear 61 and planetary gear 62. The ring gear 60 is fixed to the second end 45 of the power arm 20. The sun gear 61 is fixed to the first end 46 of the folding arm 22. The planetary gear 62 is disposed between the two gears and coordinates rotation therebetween. Thus, as the second end of the power arm 20 rotates, the folding arm rotates about its first end in a fixed relationship which is controlled by the size and number of teeth in each of the ring gear, the sun gear and the planetary gear.

The cradle arm control assembly 28 is shown in FIGS. 1 and 9 as comprising master sprocket 63, follower sprocket 64, tension sprocket 66 and chain (not shown). The master sprocket 63 is coupled to the second end 45 of the power arm 20. The follower sprocket 64 is coupled to the first end of the cradle assembly. The tension sprocket is coupled to the folding arm between the first and second ends thereof. The tension sprocket can be translated along the follower so that once the chain extends around all three sprockets, the translation of the tension sprocket can be utilized to eliminate the slack from the chain. It will be understood that as the second end 45 of the power arm 20 is rotated relative to the pivot mounting bracket 35, the cradle arm rotates about the first end thereof relative to the second end of the folding arm.

In operation, the lift is first shown in the undeployed orientation, wherein the watercraft is positioned above the platform. To initiate deployment wherein the watercraft is moved from the transom of a boat whereby the lift apparatus moves the watercraft around and over the swim platform (typically), the user first actuates the displacing member. As the displacing member contracts in length, the first arm 14 and the second arm 16 rotate in a generally downward direction. At the same time, the power arm begins to rotate relative to each of the first and second arms and about itself.

The rotational movement of the power arm 20 initiates rotational movement of each of the folding arm 22 and the cradle arm 48. The folding arm control assembly directs rotation of the folding arm 22 in some proportion to the rotation of the second end of the power arm 20 relative to the pivot mounting bracket 35. Similarly, the cradle arm control assembly 28 imparts rotation to the cradle assembly in some proportion to the rotation of the second end of the power arm 20 relative to the pivot mounting bracket 35. Due to the two control assemblies, the cradle arm 48 also rotates about its first end relative to the second end of the folding arm.

The configuration of the control assemblies maintains the cradle pad 49 in a generally horizontal configuration such that the watercraft remains substantially horizontal between the undeployed orientation and the deployed orientation. In the deployed orientation, the watercraft has approached or hit the waterline and the watercraft is in the water, ready for use. At such time, the entirety of the lift apparatus remains below the waterline or at the waterline. None of the components remain on or over the swim platform and the swim platform is again usable without obstruction.

Once it is desired to return to the undeployed orientation, the watercraft is returned to the pad. Once returned, the lift apparatus is again actuated. Once actuated, the displacing member is lengthened and the process described above is reversed causing the watercraft to return to a position wherein it overlies the platform.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A lift apparatus for loading and unloading of a watercraft from a platform comprising:

a first arm having a first end pivotably connected to a surface positioned below a platform;

a second arm having a first end pivotably connected to a surface positioned below a platform;

a power arm having a first end pivotably coupled to a second end of the second arm and a second end pivotably coupled to a second end of the first arm;

a displacing member having a first end, a second end and a variable length, the first end coupled to the outside surface and the second end coupled to the first arm proximate the second end thereof;

a folding arm having a first end and a second end, the first end of the folding arm pivotably coupled to the second end of the first arm and rotationally fixed to the second end of the power arm;

a cradle assembly having a cradle arm with a first end and a second end and a cradle pad, the cradle pad is positioned at the second end of the cradle arm and is configured to receive a watercraft thereon, the first end of the cradle assembly is pivotably coupled to the second end of the folding arm and rotationally fixed to the second end of the power arm;

whereupon variation of the length of the displacing member rotates the first and second arms about the first end and rotates the power arm about the first and second ends thereof, and, in turn, rotates the folding arm and the cradle assembly from a undeployed orientation wherein the folding arm, and the cradle arm are substantially above the platform along with a watercraft positioned upon the cradle pad to a deployed orientation wherein the folding arm, and the cradle arm are extended away from and below the platform to clear and lower the watercraft from the platform.

2. The lift apparatus of claim 1 further including a folding arm control system rotationally fixing the second end of the folding arm to the second end of the power arm, the folding arm control system comprising a ring gear fixedly coupled to one of the power arm and the folding arm, a ring gear fixedly coupled to the other of the power arm and the folding arm, and, a planetary gear engaging each of the sun gear and ring gear, to transfer motion therebetween.

3. The lift apparatus of claim 2 further including a cradle arm control assembly comprising a master sprocket fixedly coupled to the power arm and a follower sprocket fixedly coupled to the first end of the cradle arm, a chain extends about each of the follower sprocket and the master sprocket to rotatably couple the same.

4. The lift apparatus of claim 1 further including a cradle arm control assembly comprising a master sprocket fixedly coupled to the power arm and a follower sprocket fixedly coupled to the first end of the cradle arm, a chain extends about each of the follower sprocket and the master sprocket to rotatably couple the same.

5. The lift apparatus of claim 1 further comprising a mounting bracket configured to engage an outside surface and configured to provide a mounting for the first ends of each of the first arm, the second arm and the displacing member.

6. The lift apparatus of claim 1 wherein the displacing member further comprises a hydraulic cylinder.

7. The lift apparatus of claim 1 wherein the cradle pad is configured so that the watercraft positioned thereon remains substantially horizontally positioned between the deployed and undeployed orientations.

8. A combination boat and watercraft lift apparatus comprising:

a boat having a platform positioned aft thereof and elevated above a waterline;

a lift apparatus for loading and unloading of a watercraft from the platform comprising:

a first arm having a first end pivotably connected to the boat surface below the platform;

a second arm having a first end pivotably connected to the boat below the platform;

a power arm having a first end pivotably coupled to a second end of the second arm and a second end pivotably coupled to a second end of the first arm;

a displacing member having a first end, a second end and a variable length, the first end coupled to the outside surface and the second end coupled to the first arm proximate the second end thereof;

a folding arm having a first end and a second end, the first end of the folding arm pivotably coupled to the second end of the first arm and rotationally fixed to the second end of the power arm;

a cradle assembly having a cradle arm with a first end and a second end and a cradle pad, the cradle pad is positioned at the second end of the cradle arm and is configured to receive a watercraft thereon, the first end of the cradle assembly is pivotably coupled to the second end of the folding arm and rotationally fixed to the second end of the power arm;

whereupon variation of the length of the displacing member rotates the first and second arms about the first end and rotates the power arm about the first and second ends thereof, and, in turn, rotates the folding arm and the cradle assembly from a undeployed orientation wherein the folding arm, and the cradle arm are substantially overlaying the platform along with a watercraft positioned upon the cradle pad to a deployed orientation wherein the folding arm, and the cradle arm are extended away from and below the platform to clear and lower the watercraft from the platform toward the waterline.

9. The lift apparatus of claim 8 further including a folding arm control system rotationally fixing the second end of the folding arm to the second end of the power arm, the folding arm control system comprising a ring gear fixedly coupled to one of the power arm and the folding arm, a ring gear fixedly coupled to the other of the power arm and the folding arm, and, a planetary gear engaging each of the sun gear and ring gear, to transfer motion therebetween.

10. The lift apparatus of claim 9 further including a cradle arm control assembly comprising a master sprocket fixedly coupled to the power arm and a follower sprocket fixedly coupled to the first end of the cradle arm, a chain extends about each of the follower sprocket and the master sprocket to rotatably couple the same.

11. The lift apparatus of claim 8 further including a cradle arm control assembly comprising a master sprocket fixedly coupled to the power arm and a follower sprocket fixedly coupled to the first end of the cradle arm, a chain extends about each of the follower sprocket and the master sprocket to rotatably couple the same.

12. The lift apparatus of claim 8 further comprising a mounting bracket configured to engage an outside surface and configured to provide a mounting for the first ends of each of the first arm, the second arm and the displacing member.

13. The lift apparatus of claim 8 wherein the displacing member further comprises a hydraulic cylinder.

14. The lift apparatus of claim 8 wherein the cradle pad is configured so that the watercraft positioned thereon remains substantially horizontally positioned between the deployed and undeployed orientations.

15. A method for selectively deploying a watercraft from a platform comprising the steps of:

providing a lift apparatus of claim 1;

actuating the lift apparatus to lengthen the length of the displacing member;

rotating the first and second arms, to in turn, raise the watercraft from the platform;

displacing the watercraft outwardly and away from the platform; and downwardly moving the watercraft once the watercraft has moved outwardly beyond the platform toward the waterline.

* * * * *